US009246266B2

(12) United States Patent
Werner

(10) Patent No.: US 9,246,266 B2
(45) Date of Patent: Jan. 26, 2016

(54) PLUG-CONNECTABLE EQUIPMENT COMBINATION

(71) Applicant: ELLENBERGER & POENSGEN GMBH, Altdorf (DE)

(72) Inventor: Klaus Werner, Roethenbach (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 0 days.

(21) Appl. No.: 14/277,864

(22) Filed: May 15, 2014

(65) Prior Publication Data

US 2014/0273592 A1 Sep. 18, 2014

Related U.S. Application Data

(63) Continuation of application No. PCT/EP2012/003860, filed on Sep. 14, 2012.

(30) Foreign Application Priority Data

Nov. 15, 2011 (DE) ..... 10 2011 118 524

(51) Int. Cl.
*H01R 13/627* (2006.01)
*H01R 9/26* (2006.01)
*H01R 9/24* (2006.01)

(52) U.S. Cl.
CPC ..... *H01R 13/627* (2013.01); *H01R 9/2608* (2013.01); *H01R 13/6272* (2013.01); *H01R 9/2441* (2013.01)

(58) Field of Classification Search
CPC ..... H01R 9/2441; H01R 13/627; H01R 13/6272; H01R 9/2608
USPC ..... 439/350, 357, 353–354, 358
See application file for complete search history.

(56) References Cited

U.S. PATENT DOCUMENTS

| | | | | |
|---|---|---|---|---|
| 5,860,826 | A * | 1/1999 | Chang | 439/358 |
| 6,146,182 | A * | 11/2000 | Wang et al. | 439/357 |
| 6,340,306 | B1 | 1/2002 | Daoud | |
| 6,454,608 | B1 * | 9/2002 | Kitahara et al. | 439/638 |
| 7,483,278 | B2 * | 1/2009 | Otto et al. | 361/823 |
| 7,806,716 | B2 | 10/2010 | Zahlmann et al. | |
| 8,262,403 | B2 * | 9/2012 | Slippy et al. | 439/353 |
| 2002/0155746 | A1 | 10/2002 | Simpson | |
| 2008/0254655 | A1 | 10/2008 | Zahlmann et al. | |

FOREIGN PATENT DOCUMENTS

| | | | |
|---|---|---|---|
| CN | 1643734 | A | 7/2005 |
| CN | 101190916 | A | 7/2009 |

(Continued)

*Primary Examiner* — Edwin A. Leon
(74) *Attorney, Agent, or Firm* — Laurence A. Greenberg; Werner H. Stemer; Ralph E. Locher

(57) ABSTRACT

A plug-connectible equipment combination has a plug module and an equipment socket with a latching connection. A rotation point is formed on the plug module between an attachment on the housing side for a latching arm and the latching catch of the latching arm. A pivoting section is formed between the rotation point and the latching catch and an actuating section for exerting pressure is formed between the rotation point and the attachment of the latching arm on the housing. The pivoting section of the latching arm pivots outwards about the rotation point and the latching catch is released from the mating latch.

10 Claims, 5 Drawing Sheets

(56) References Cited

FOREIGN PATENT DOCUMENTS

| | | | |
|---|---|---|---|
| DE | 102006033274 | A1 | 1/2008 |
| JP | S60101392 | U | 7/1985 |
| JP | S6340306 | A | 2/1988 |
| JP | H067167 | B2 | 1/1994 |
| JP | 2003343642 | A | 12/2003 |
| JP | 2008527729 | A | 7/2008 |
| JP | 2009193920 | A | 8/2009 |
| JP | 2009544127 | A | 12/2009 |
| WO | 9512905 | A1 | 5/1995 |

* cited by examiner

PLUG-CONNECTABLE EQUIPMENT COMBINATION

CROSS-REFERENCE TO RELATED APPLICATION

This application is a continuation, under 35 U.S.C. §120, of copending international application No. PCT/EP2012/003860, filed Sep. 14, 2012, which designated the United States; this application also claims the priority, under 35 U.S.C. §119, of German patent application DE 10 2011 118 524.4, filed Nov. 15, 2011; the prior applications are herewith incorporated by reference in their entirety.

BACKGROUND OF THE INVENTION

Field of the Invention

The invention relates to a pluggable device combination having a plug module and a device bedplate wherein a latching arm, which has a latching hooked formed as one piece on its end face, is connected to the latching connection of said device bedplate and to the plug module on the housing side, and said latching arm cooperates with a mating latch of the device bedplate for the purpose of forming a latching connection that can be detached by virtue of applying force. The plug module is in particular an overload safety switch.

International patent application publication WO 95/12905 A1 describes a pluggable device combination having a latching connection between a plug module and a U-shaped sub-frame having latching lugs that are provided on opposite lying sides of the plug module and said latching lugs protrude towards the exterior and can latch with mating latches on the sub-frame. The respective latching lug is located on the side wall of the plug module on a snap arm that can be deformed in a resilient manner towards the interior and is formed as one piece on the plug module housing for the purpose of forming a hinged joint. The hinged joint is located on the underside of the plug module that is facing towards the base of the U-shaped sub-frame. The latching connection can be detached by virtue of applying pressure to an actuating protrusion on the snap arm.

German published patent application DE 10 2006 033 274 A1 describes a pluggable device combination having a bedplate type U-shaped sub-frame for the purpose of receiving a plug module that receives an overvoltage safety element, wherein in turn latching means are provided that likewise comprise latching lugs on the two opposite-lying end faces of the plug modules and said latching lugs engage in each case in an associated undercut latching recess on the plug module. The plug module-side latching lugs are embodied in each case on a hinged joint that is pre-stressed, wherein the latching connection can be detached by virtue of applying pressure to the hinged joint on the end faces of the plug module. The application of pressure on an actuating surface that is facing towards a bedplate type sub-frame causes the latching lug to pivot towards the module housing in order to detach the two sided latching connections with the latching recesses of the device bedplate type sub-frame.

SUMMARY OF THE INVENTION

It is accordingly an object of the invention to provide a pluggable device combination which overcome the above-mentioned disadvantages of the heretofore-known devices of this general type and which provides for an improved pluggable device combination that involves a reduced expenditure and also comprises an easily manageable latching connection.

With the foregoing and other objects in view there is provided, in accordance with the invention, a pluggable device combination, comprising:

- a device bedplate having a bedplate base and plugging surfaces laterally flanking said bedplate base;
- a plug module projecting between said plugging surfaces, said plug module having a module housing and a latching arm formed on said module housing and extending in a direction towards said device bedplate;
- said latching arm extending from a housing-side connection at said module housing to an end formed with a latching hook;
- a mating latch formed on one of said plugging surfaces and configured to mate with said latching hook of said plug module for forming a pressure-releasable latching connection;
- said plug module having a pivot site formed between said housing-side connection of said latching arm and said latching hook of said latching arm;
- said latching arm having a pivoting section formed between said pivot site and said latching hook and an actuating section formed on said latching arm between said pivot site and said housing-side connection, wherein, when a pressure force is applied to said actuating section, said pivoting section of said latching arm pivots about said pivot site outwardly away and detaches said latching hook from said mating latch.

In other words, the plug-connectible or pluggable device combination comprises a device bedplate and a plug module that receives safety switch elements, and a latching arm that extends in the direction towards the device bedplate and comprises a latching hook that is formed as one piece on the end face of said latching arm is connected to the module housing of said plug module. In particular, it is preferred that only one individual latching arm is provided. The protrusion-like connecting site of said latching arm is located on one of the narrow sides of the module housing in the upper housing region that is lying remote from the device bedplate.

In the plugged device combination, the plug module sits in the device bedplate between plugging surfaces that laterally flank a bedplate base, wherein a mating latch that can latch with the latching hook of the plug module is formed as one piece only on one of the plugging surfaces for the purpose of forming a latching connection. A pivot site is formed between the housing-side connection of the latching arm and the latching hook of said latching arm so that a pivoting section of the latching arm is achieved between the pivot site and the latching hook and also an actuating section for the purpose of applying pressure is achieved on said pivoting section between the pivot site and the housing-side connection of the latching arm. As a consequence, the pivoting section of the latching arm pivots about the pivot site so that the latching connection is detached.

The pivot site is embodied from a protrusion that is located on the rear side of the latching arm and is formed as one piece laterally on the module housing. This protrusion can be connected to the latching arm in particular as one piece. Where necessary, a pivot joint is formed by means of the protrusion that is formed as one piece on both the module housing and also the latching arm. On the other hand, if the latching arm lies only on the protrusion without a material connection, a pivot point or rather a linear pivot is formed at this site.

The latching arm that is preferably arranged on the upper face of the module housing and is formed as one piece laterally on said module housing extends beyond the pivot site and terminates with its latching hook behind or rather underneath the base-side mating latch (mating latch hook). It is preferred that the pivot point is provided in the lower section half that is facing towards the device bedplate so that the pivoting section of the latching arm between the pivot site and the latching hook is shorter than the actuating section of the latching arm that is formed between the housing-side connection of the latching arm and the pivot site. The plug module-side latching hook is located on the interior face or rear face of the latching arm that is facing towards the module housing of the plug module and is facing towards the corresponding side face of the module housing. The mating latching surface of the bedplate-side mating latch extends from the module housing towards the exterior.

The latching arm is formed as one piece on the corresponding housing narrow side in such a manner that a housing chamber is formed between the latching arm and the housing narrow side. The bedplate-side mating latch protrudes in this housing chamber and into the chamber section that is located underneath the pivot site and faces the device bedplate for the purpose of producing the latching connection. As a consequence, it is advantageously achieved that neither the latching arm nor its latching hook protrude beyond the side surface of the module housing of the plug module even when said latching arm is connected in a latching manner to the base-side mating latch neither in the plugged state nor in the unplugged state.

In one expedient embodiment, the latching arm is bent in the region of the pivot site in such a manner that the pivoting section of the latching arm is spaced at a shorter distance from the module housing or rather from the side surface of said module housing than the actuating section of the latching arm. In this manner, the outer contour of the latching arm and of the latching connection match the outer contour of the plug module in a particularly consistent manner.

The device bedplate comprises in the bedplate itself contact elements that are connected in an electrically conductive manner to clamps that can be accessed from the exterior, and said contact elements can be accessed by way of the base of the device bedplate and correspond with contact elements that protrude out of the plug module on the base side. By way of example, five plug contact connections of this type are provided.

In one advantageous development, the device combination comprises a plug coding arrangement between the plug module and the housing base. Said plug coding arrangement is formed in a suitable manner by means of plug module-side plug pockets and base-side hollow coding pins that engage in the plug pockets of the plug module in a positive-locking manner. The plug pockets comprise preferably pin-shaped coding elements that are formed for the purpose of forming a predetermined breaking point and that can be broken off individually. The corresponding bedplate-side hollow coding pins that protrude upwards out of the base of the device bedplate comprise in each case a hollow chamber that can be closed for coding purposes. For this purpose, by way of example coding elements that are provided can be plugged into the individual hollow coding pins. Where necessary, a plug module wherein a corresponding coding element has not been broken off from the respective plug pocket cannot be combined with this coded device bedplate.

Other features which are considered as characteristic for the invention are set forth in the appended claims.

Although the invention is illustrated and described herein as embodied in Pluggable Equipment Combination, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Parts that correspond to one another in structural and functional terms are provided with identical reference numerals throughout the figures.

DETAILED DESCRIPTION OF THE INVENTION

Figure 1:
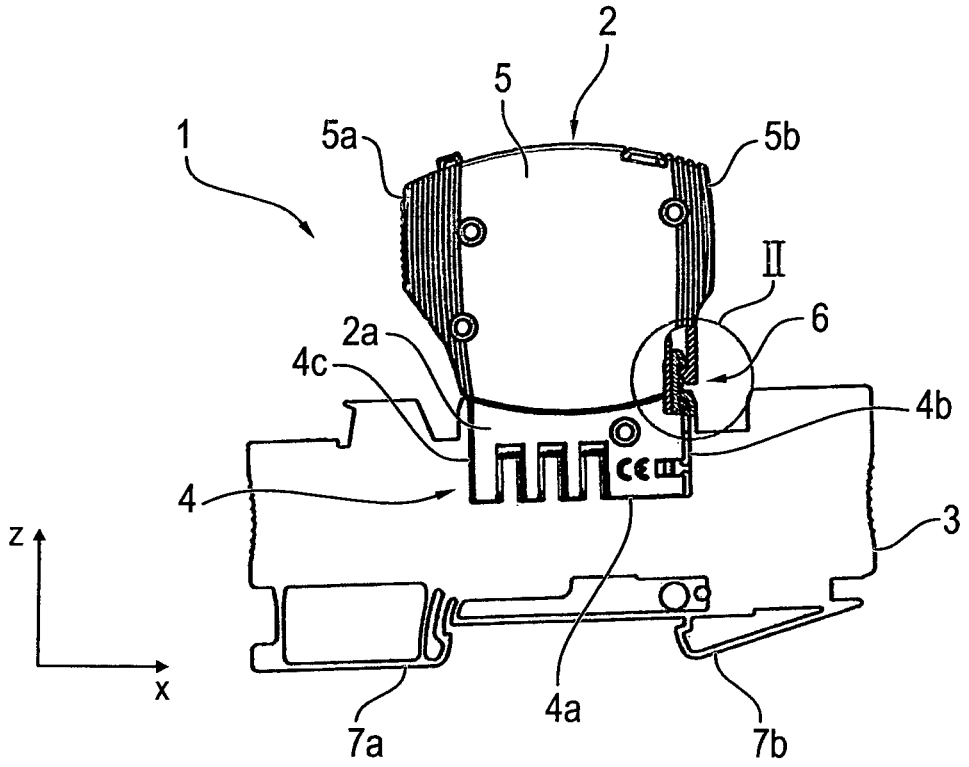
FIG. 1 illustrates a lateral view of a pluggable device combination having a device bedplate and a plug module.

Referring now to the figures of the drawing in detail and first, particularly, to FIG. 1 thereof, there is shown a device combination 1 having a plug module 2 and a device bedplate 3 that comprises a U-shaped plugging region or section 4 having two plugging surfaces 4*b* and 4*c* that are laterally flanking the bedplate base 4*a*. The plug module 2 is received by the plugging region 4 in a virtually positive-locking manner and said plug module lies with its plugging shaft (plugging region or section) 2*a* on the one hand on the bedplate base 4*a* and on the other hand on the side surface 4*b*, 4*c*. The plug module 2 comprises a module housing 5 having narrow or housing narrow sides 5*a* and 5*b* that lie opposite one another.

A latching connection 6 is located only on one of the two narrow sides 5*b* between the plug module 2 and the device bedplate 3 and the plug module 2 latches with the device bedplate 3 in a detachable manner by way of said latching connection. Holding or snap-action contours 7*a*, 7*b* are formed on the base-side on the device bedplate 3 for a cap rail assembly of the device combination.

Figure 2:
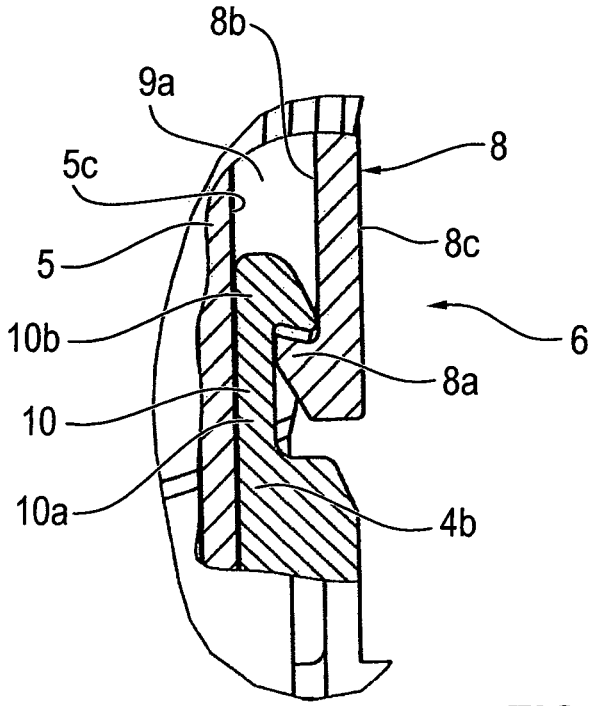
FIG. 2 illustrates a view in an enlarged scale of the detail II from FIG. 1 with the individual latching site between the plug module and the device bedplate.

FIG. 2 illustrates a scaled-up view of area II of the latching connection 6 shown in FIG. 1. The plug module 2 comprises on its housing narrow side 5*b* a latching arm 8 that is involved in the latching connection 6 and said latching arm extends along the housing narrow side 5*b* in the direction z towards the device bedplate 3 and supports on its free end a latching hook 8*a*. The latching hook 8*a* is arranged with its latching surface (not illustrated in detail) towards the module housing 5 and on the housing narrow side 5*b* of said module housing towards a narrow-sided housing partition wall or 5*c* that is subsequently described as an interior wall. A lower chamber section 9*a* of a housing chamber 9 (FIGS. 3 and 4) is formed between this interior wall 5*c* and the rear face 8*b* of the latching arm 8 that faces said interior wall 5*c*. A mating latch 10 protrudes into this lower chamber section 9*a* of the housing chamber 9 with its mating latching hooks 10*b* that are formed on the free end of a latching shaft 10*a*.

The mating latch 10 is formed on the bedplate side in the region of the plugging surface 4*b* on the device bedplate 3 and extends so to speak in the direction z as an extension of the plugging surface 4*b*. The mating latching hook 10*b* of the mating latch 10 extends in turn with its non-illustrated mating latch surface from the module housing 5 and as a consequence from the plug module 2 towards the exterior in the direction x. The latching hook 8*a* of the plug module-side latching arm 8 is located on the end of a pivoting section 8*c* of the latching arm 8, said end facing towards the device bedplate 3.

Figure 3:
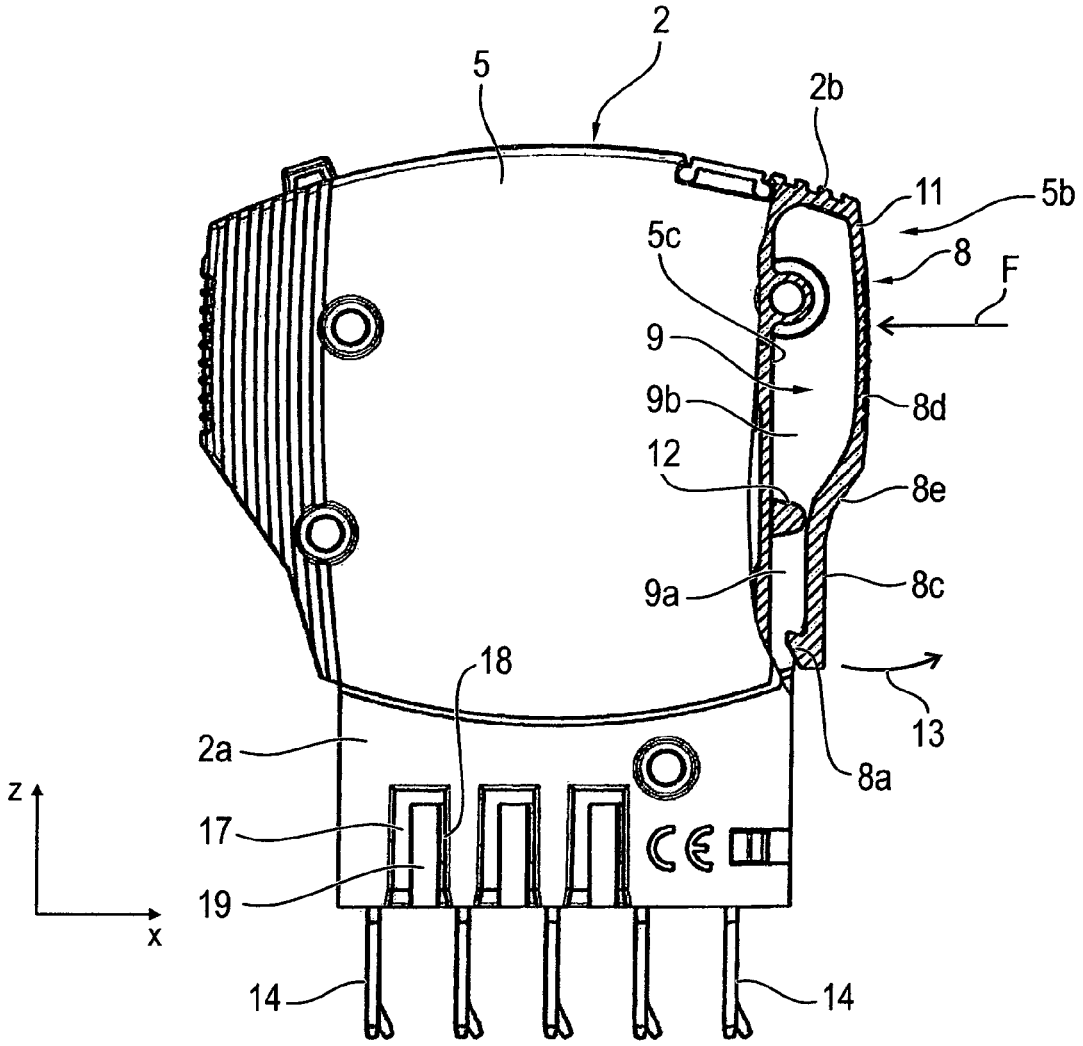
FIG. 3 illustrates the plug module together with a module housing that is cut away in the region of a latching arm and comprises a pivot site protrusion that is formed on said module housing.
Figure 4:
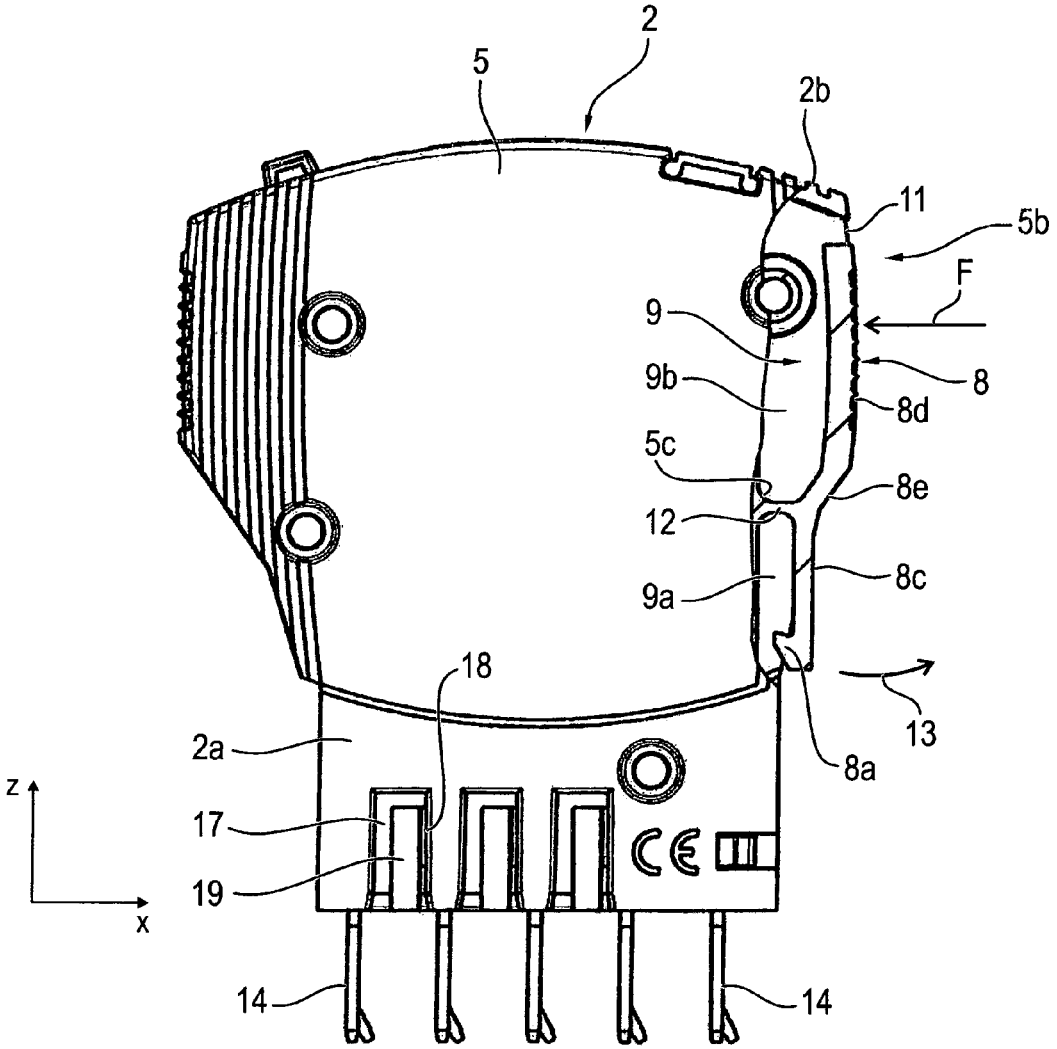
FIG. 4 illustrates the plug module in an view in accordance with FIG. 3 together with a pivot joint formed on said plug module.
Figure 5:
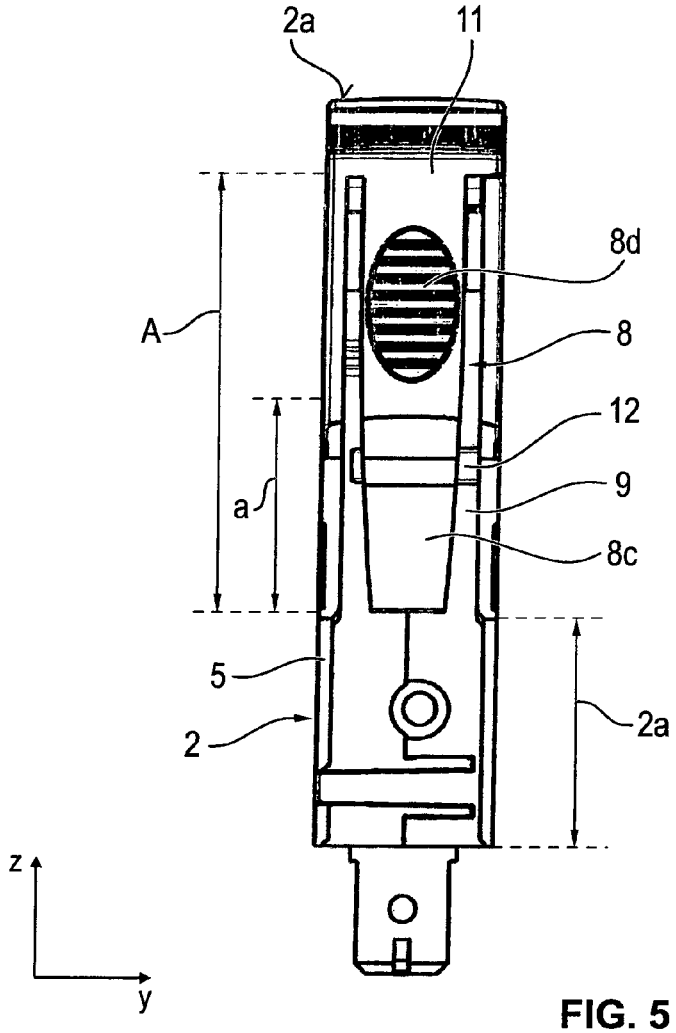
FIG. 5 illustrates a lateral view of the plug module with a view of the latching arm.
Figure 6:
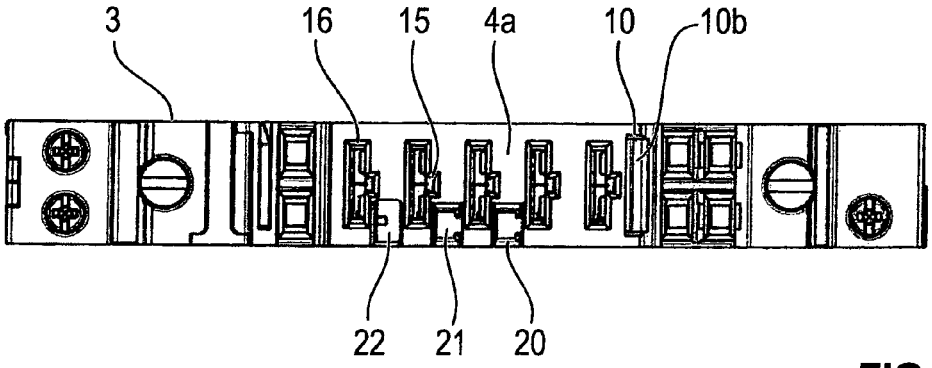
FIG. 6 illustrates the device bedplate with a view of its base having hollow coding pins that are formed as one piece on said base.

As is by way of comparison evident in the FIGS. 3 to 5, the plug module-side latching arm 8 is formed on the housing narrow side 5*b* on the module housing 5, wherein a corresponding connection or rather connection site 11 of the latching arm 8 is located on the housing narrow side 5*b* in the region of the module upper face 2*b* that is remote from the plugging shaft 2*a* of the plug module 2.

Along the plug module-side latching arm 8, a protrusion 12 that extends in the direction x and towards the latching arm 8 is formed on the interior wall 5*c* of the housing narrow side 5*b* of the module housing 5. Said protrusion forms a pivot site for the purpose of pivoting the lower pivoting section 8*c* of the latching arm 8 as a result of a force F that acts on said latching arm. The force F is applied manually onto an actuating section 8*d* of the plug module-side latching arm 8, said actuating section being connected to the pivoting section 8*c* in the direction z.

As a consequence, the pivot site 12 is located in the transition region between the actuating section 8*d* and the pivoting section 8*c* of the latching arm 8. The pivoting section 8*c* is—when seen in the direction z or rather in the longitudinal section of the latching arm 8—shorter than the actuating section 8*d*. The pivot site 12 is provided in the lower section half a of the longitudinal direction A that is formed between the housing-side connection 11 of the latching arm 8 and the latching hook 8*a* of said latching arm, said lower section half facing towards the device bedplate 3.

As a consequence of the illustrated effect of the force F in the opposite direction (−x) to the illustrated direction x, in other words on the plug module 2 and accordingly on its module housing 5, the pivoting section 8*c* of the latching arm 8 pivots about the pivot site 12 towards the exterior in the opposite direction (x), as is illustrated by means of the direction arrow 13.

Whereas in the case of the embodiment in accordance with FIG. 3, the latching arm 8 lies on the protrusion 12, whereby a point or linear pivot site is formed, in the case of the embodiment in accordance with FIG. 4, the protrusion 12 is also connected by means of a material connection to the latching arm 8 or rather to the rear face 8*b* of said latching arm for the purpose of forming a pivot site in the form of a type of pivot joint and as a consequence, said protrusion is connected to the module housing 5 and to the interior wall 5*c* of said housing module by way of this protrusion 12.

In the case of two embodiments according to FIGS. 3 and 4, the pivot site 12 separates the housing chamber 9 that is formed between the latching arm 8, or rather its rear face 8*b*, and the housing narrow side 5*b*, or rather its interior wall 5*c*, into the lower chamber region 9*a*, which is already described with reference to FIG. 2, and an upper chamber region 9*b*. As a consequence, said chamber region 9*b* extends between the pivot site 12 and the connecting site 11 of the latching arm 8 on the module housing 5. In the case of the force F being applied to the actuating section 8*d* in the direction (−x), it is possible for said actuating section to deflect or rather depress into the upper chamber section 9*b*, whereas, as a consequence of this, the lower pivoting section of the 8*c* of the latching arm 8 pivots about the pivot site 12 in the opposite direction x.

The latching arm 8 is bent in the region of the pivot site 12, wherein a correspondingly curved or narrower contour 8*e* is formed. As a consequence of this curved or narrower contour 8*e*, the lower chamber section 9*a* of the housing chamber 9 is restricted in comparison to the upper housing chamber 9*b* in the direction x. The pivoting section 8*c* of the latching arm 8 is consequently spaced at a shorter distance from the housing inner wall 5*c* in comparison to its actuating section 8*d*.

The plug module 2 comprises module-side contact elements 14 that protrude on the base side from the module housing 5. Said contact elements correspond with the bedplate-side contact elements 15 that can be accessed by way of plug openings 16 in the bedplate base 4*a* of the device bedplate 3.

The illustrated and described pluggable device combination 1 is coded in an expedient manner. For this purpose, the plug module 2 on the one hand and the device bedplate 3 on the other side comprise coding elements. On the plug module-side, these coding elements are formed by means of plug pockets 17 that extend in the direction z with coding pins 19 that are formed as part thereof for the purpose of providing a predetermined breaking point 18. Hollow coding pins or domes 20 that protrude upwards out of the bedplate base 4*a* correspond to the plug module-side plug pockets 17. The hollow spaces 21 of said pins or domes receive the plug module-side coding pins 19 during the course of the plugging process of the plug module 2 having the device bedplate 3, whereas simultaneously the hollow coding pins 20 are received by the respective corresponding plug module-side plug pocket 17.

Individual hollow chambers 21 of the hollow coding pins 20 are closed for coding purposes by means of pre-positioned blocking pins 22. As a consequence, a plug module 2 whose coding pin 19 is not broken off at the corresponding point cannot be combined with the correspondingly coded device bedplate 3.

Figure 7:
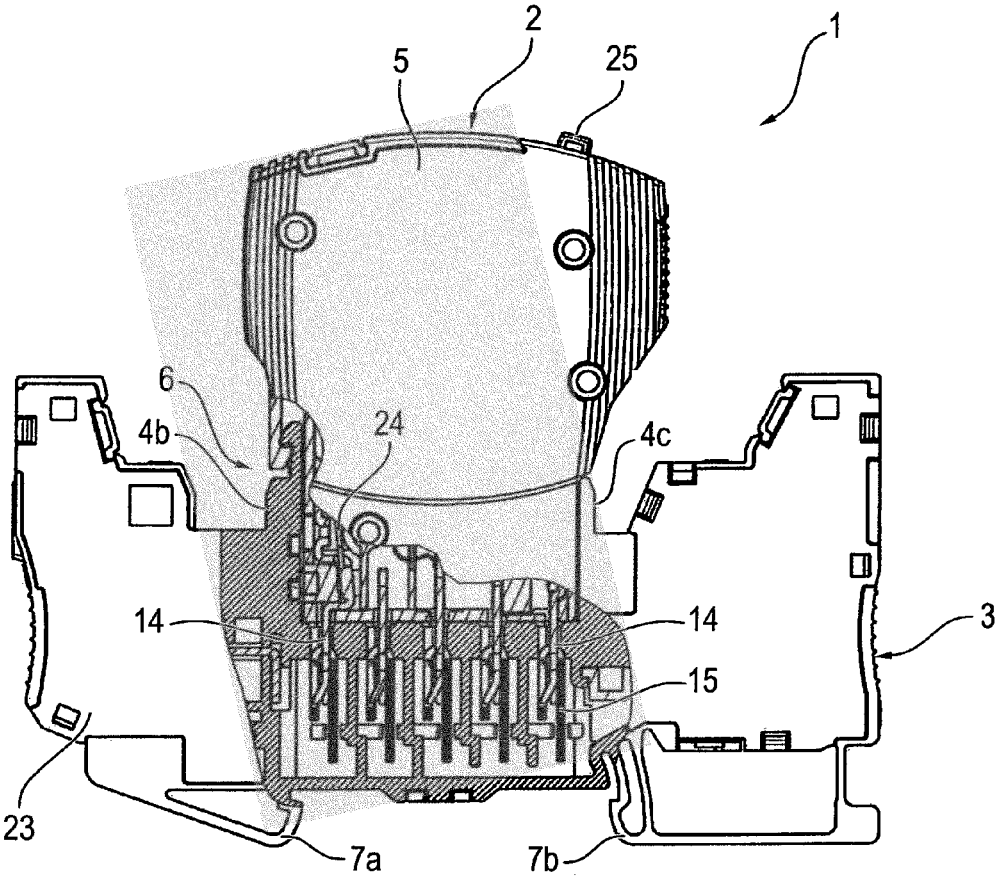
FIG. 7 illustrates the pluggable device combination in accordance with FIG. 1 in a partial sectional view with a view of contact elements that are inside the device.

FIG. 7 illustrates the device combination 1 in a rear view with respect to the illustration in accordance with FIG. 1 with the plugging region between the plug module 2 and the device bedplate 3 cut-away housings. The contact arrangement between the plug module-side contact elements 14 and the bedplate-side contact elements 15 within the bedplate housing 23 of the device bedplate 3 is evident. As a result of the rear view of the device combination 1, the individual latching connection 6 between the plug module 2 and the device socket 3 is now on the left-hand side of the figure. A bimetal piece or bimetal strip 24 is connected within the module housing 5—to one of the contact elements 14 in an electrically conductive manner—as a thermal tripping device in the event of an overload.

In the case of the plug module 2, a manual tripping device 25 protrudes out of the module housing 5 of said plug module and said plug module is consequently an overload safety switch.

The following is a summary list of reference numerals and the corresponding structure used in the above description of the invention:

1 Device Combination
2 Plug Module
2*a* Plugging Shaft
2*b* Module Upper Face
3 Device Bedplate
4 Plugging Region/Section
4*a* Bedplate Base
4*b, c* Plugging Surface
5 Module Housing
5*a, b* Housing Narrow Side
5*c* Housing Partition Wall/Interior Wall
6 Latching Connection
7*a, b* Holding/Snap-action Contour
8 Latching Arm
8*a* Latching Hook
8*b* Rear Face
8*c* Pivoting Section
8*d* Actuating Section
8*e* Curved/Narrower Contour
9 Housing Chamber
9*a* Lower Chamber Section
9*b* Upper Chamber Section
10 Mating Latch
10*a* Latching Shaft
10*b* Mating Latching Hook
11 Connection/-Site
12 Protrusion/Pivot Site
13 Direction Arrow
14 Module-side Contact Element
15 Bedplate-Side Contact Element
16 Plug Opening
17 Plug Pocket
18 Predetermined Breaking Point
19 Coding Pin
20 Hollow Coding Pin/Dome
21 Hollow Chamber
22 Blocking Pin
23 Bedplate Housing
24 Bimetall Piece/Strip
25 Manual Tripping Device
A Longitudinal Section
a Section Half
F Force

The invention claimed is:

1. A pluggable device combination, comprising:

a device bedplate having a bedplate base and plugging surfaces laterally flanking said bedplate base;

a plug module projecting between said plugging surfaces, said plug module having a module housing and a latching arm formed on said module housing and extending in a direction towards said device bedplate;

said latching arm extending from a housing-side connection at said module housing to an end formed with a latching hook;

a mating latch formed on one of said plugging surfaces and configured to mate with said latching hook of said plug module for forming a pressure-releasable latching connection;

said plug module being formed with plug pockets that are open on one side and are located between said plugging surfaces of said bedplate base, said plug pockets having coding elements formed with a predetermined breaking point enabling said coding elements to be individually broken off for coding purposes; and said device bedplate including hollow coding pins protruding upwards out of said bedplate base and fitting into said plug module-side plug pockets and also receiving said plug module-side coding elements, and wherein said hollow coding pins are closeable for coding purposes;

said plug module having a pivot site formed between said housing-side connection of said latching arm and said latching hook of said latching arm;

said latching arm having a pivoting section formed between said pivot site and said latching hook and an actuating section formed on said latching arm between said pivot site and said housing-side connection, wherein, when a pressure force is applied to said actuating section, said pivoting section of said latching arm pivots about said pivot site outwardly away and detaches said latching hook from said mating latch.

2. The pluggable device combination according to claim 1, wherein said plug module is an overvoltage safety device.

3. The pluggable device combination according to claim 1, wherein said pivot site is disposed in a lower section half of a segment formed between the housing side connection of said latching arm and said latching hook of said latching arm, and said lower section half faces towards said device bedplate.

4. The pluggable device combination according to claim 1, which comprises a protrusion formed as one on said module housing and configured to form a punctiform or linear pivot site.

5. The pluggable device combination according to claim 1, which comprises a web-shaped protrusion formed on said module housing and on said latching arm for forming an articulated pivot site.

6. The pluggable device combination according to claim 1, wherein:

said latching hook is formed in one piece on an interior face of said latching arm; and a mating latch hook of said mating latch is disposed facing away from said module housing.

7. The pluggable device combination according to claim 1, wherein said latching arm is formed as one piece on a housing narrow side of said module housing and forming with said module housing a housing chamber, and a bedplate-side mating latch is formed to protrude into said housing chamber for producing the latching connection.

8. The pluggable device combination according to claim 1, wherein said latching arm is bent in the region of said pivot site to cause said pivoting section of said latching arm to be spaced at a shorter distance from said module housing than said actuating section of said latching arm.

9. The pluggable device combination according to claim 1, wherein said device bedplate comprises bedplate-side contact elements configured for access by way of a bedplate base of said device bedplate and said contact elements correspond to plug module-side contact elements that project from a base side of said plug module, wherein said bedplate-side contact elements are in electrically conductive contact with clamps ( ) that can be accessed on the other side of said plugging surface.

10. The pluggable device combination according to claim 8, which comprises a plug coding arrangement between said plug module and said device bedplate.

* * * * *